United States Patent [19]

Schieber

[11] Patent Number: 5,071,381

[45] Date of Patent: Dec. 10, 1991

[54] PROCESS FÓR THE MANUFACTURE OF STRAW TUBE DRIFT CHAMBERS

[75] Inventor: Leonard Schieber, Huntington, N.Y.

[73] Assignee: Advanced Interconnect Technology Inc., Islip, N.Y.

[21] Appl. No.: 490,078

[22] Filed: Mar. 7, 1990

[51] Int. Cl.[5] ..... H01J 47/02

[52] U.S. Cl. ..... 445/22; 250/385.1; 445/29; 156/155; 156/196; 156/308.4

[58] Field of Search ..... 313/230, 363.1; 250/374, 385.1; 445/22, 29; 156/155, 196, 228, 308.4

[56] References Cited

U.S. PATENT DOCUMENTS 3,674,602 7/1972 Keogh et al. ..... 156/380

FOREIGN PATENT DOCUMENTS 7703944 10/1978 Netherlands ..... 250/385.1

OTHER PUBLICATIONS

Harold Ogren, SSC Tracking Detectors: Straw Tube Drift Chambers, Jul. 24, 1989, presented Vancouver, B.C.

*Primary Examiner*—Kenneth J. Ramsey
*Attorney, Agent, or Firm*—Morgan & Finnegan

[57] ABSTRACT

A process for manufacturing straw tube drift chambers in an array configuration is provided. The process of manufacturing the straw tubes includes the construction of an array of tube sections, followed by the positioning of a conductive wire, and then closing the tubes. The completed straw tube array, when filled with ionizable gases, are configured about a particle accelerator collision point to provide a means for detecting the products of the collision (secondary particles) as they pass through the straw tube chambers.

20 Claims, 2 Drawing Sheets

PROCESS FOR THE MANUFACTURE OF STRAW TUBE DRIFT CHAMBERS

FIELD OF THE INVENTION

This invention relates generally to processes for manufacturing straw tube drift chambers and, more specifically, to processes for the manufacture and use of tubes in shapes that are both strong, thin and space efficient, thus allowing for chambers that are longer, provide better resolution, and are more readily manufactured.

BACKGROUND OF THE INVENTION

A straw tube drift chamber is used in the detection of secondary particles produced by accelerated particle collisions. These chambers consist of ionizable gas filled tubes with a conductive wire running lengthwise down the tube's center. The wire enclosed in the tube is under tension to maintain it in alignment within the tube.

The tube itself is made of conductive material (typically aluminized mylar laminated on a carbon composite film) and acts as the cathode of the cell when a high voltage is applied to the wire (anode). The tubes are small in diameter (on the order of 4 to 8 mm). The small size allows for arrays of more tubes in smaller areas, thus, providing detectors with higher resolution than can otherwise be obtained.

Large arrays of these thin straw tube chambers are configured about the collision point of a particle accelerator to detect and track collision products of the primary impact. These collision products are called secondary particles. As a secondary particle passes through the tube of the straw tube chamber, the gas is ionized and a trail of electrons migrate to the conductive wire. This trail of electrons provides a signal that a secondary particle has passed through the straw tube near that location. The signal is a measurable charge that is recorded by the instruments monitoring the straw tube chamber array.

Conventional technology utilized drinking straw apparatus and techniques to form straw tubes. These tubes are generally circular in cross section. After the tubes are formed, a conductive wire is threaded from one end of the tube to the other, tensioned and then fixed in position.

A number of universities and private organizations have conducted research in the area of straw tube production materials, size and resolution. One of the first array of straw tube chambers was called the HRS vertex chamber and was constructed at Indiana University in 1981. The chamber had an array of 356 circular tubes. Each of the tubes was 46 cm long with walls made of 85 micron thick aluminized mylar.

A similar chamber built at the University of Colorado, reportedly had an array of 640 eight millimeter diameter cells circular with a length of 84 cm. The walls of that cell were also made of aluminized mylar with a thickness of 75 microns.

Chambers were also built at other institutions. Normally, aluminized polycarbonate, aluminized mylar, or a composite of the two materials were used for the conductive tube with a wall thickness of 25 to 85 microns. The total number of cells were in the hundreds, the lengths were on the order of 40 to 60 cm, and the tube diameters ranged between 4 and 7 mm.

The length of the tubes is necessarily limited by the manufacturing apparatus and method, and the materials of construction. It is also limited by the strength and stiffness of the conductive wire within the tube.

The dimensions of the tubes are directly related to the resolution of the chamber. Smaller, longer tubes can lead to better resolution because they can utilize space more efficiently. However, the drinking straw manufacturing technology used to produce these straw tubes places limits on the dimensions. Similarly, since it is necessary to thread the tube with conductive wire, a certain minimum tube diameter must be maintained.

In addition, resolution is directly related to the shape of the tubes. When the shape allows for a tight packing density, more tubes can be positioned in a given area and detection of the passing particles can be measured at more locations. Under the present manufacturing technology, the tubes are generally circular. Therefore, when packed into an array, there are gaps in the array corresponding to the dead spaces therebetween.

Further, the threading process in the present method of manufacturing straw tubes is an additional limitation on the size of the tube arrays. It takes some time to position the conductive wire in the tube structure. In cases where thousands of completed tubes, not hundreds, are needed, the process becomes inefficient. This inefficiency provides incentive to limit the number of tubes used in an array, which limitation influences resolution.

With more and more emphasis being placed the better resolution, the size and shape of straw tube detectors becomes increasingly important. The smaller the tube and the more the tube's shape allows for higher packing densities, the more tubes can be packed into a given space which results in a higher resolution. This increased sensitivity allows for the location of a penetrating particle to be pinpointed and tracked more accurately.

However, conventional straw making technology is not practical for mass production needs of extremely thin straw tube chambers.

OBJECTS OF THE INVENTION

Accordingly, it is an object of this invention to provide a method of manufacturing straw tube detectors which is more efficient than conventional manufacturing techniques.

It is another object of this invention to provide methods of manufacturing of large quantities of straw tubes at a reduced cost.

It is also an object of the present invention to provide a method of manufacturing straw tube detectors which are structurally superior to existing straw tubes.

It is a further object of this invention to provide a method of manufacturing mass numbers of straw tubes in an array of predetermined thinner sizes.

Another object of this invention is to provide a method of manufacturing straw tube detectors which allow for more efficient space utilization and, therefore, better resolution of detected particles.

SUMMARY OF THE INVENTION

The present invention provides processes for the more efficient and cost effective construction of strong straw tubes of varying shapes. The processes include the forming of straw tubes open along a longitudinal face. The tubes may be manufactured singularly or in an array. Formation may be accomplished by known forming techniques including extrusion, vaccuforming, etc. Each tube section, an incomplete embodiment of the final shape, has an opening along its longitudinal section to permit a conductive wire to be laid lengthwise through the opening.

After the tube section is formed, the conductive wire is positioned inside of the tube. The wire may be tensioned either before or after it is placed in the center of the tube. The main concern is that each wire be as close to the center of its respective straw tubes as possible without contacting the sidewalls. The wire used should preferably be highly conductive and strong (e.g. gold-plated tungsten, copper, silver).

Once the wire is in position, the opening in the tube is closed. This step may be accomplished by positioning another tube structure or an array of tubes over the first tube or set of tubes. Alternatively, a strip corresponding to the missing section of the tube's geometric shape may be affixed to the tube to encapsulate the wire. It is also envisioned that the structure be configured so that a force may be applied to the tube to close the structure. The completed tube may be formed in a variety of shapes (e.g. triangular, square, hexagonal, octagonal, circular). The wall of the straw tube would be made of a conductive material, or of a non-conductive material which had been coated with a second layer of conductive material so as to render the composite conductive.

When the structure is complete, the tube is electrically isolated from the conductive wire such that a potential difference may be established between the tube and the wire.

The area within the tube is then filled with ionizable gas (e.g., argon-ethane, freon). It is envisioned that the tube itself may be separately filled and sealed. Also, the tube array may be isolated and filled such that the gases envelop tubes collectively. At this point the manufacturing process is complete and the straw tube array may be installed in the desired location.

BRIEF DESCRIPTION OF THE DRAWINGS

The above and other objects, features and advantages of this invention will be apparent in the following detailed description of preferred embodiments, especially when taken in conjunction with the accompanying drawing; wherein.

DETAILED DESCRIPTION OF PREFERRED EMBODIMENTS

Figure 1:
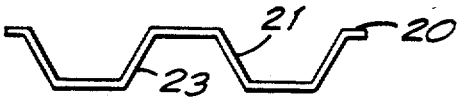
FIG. 1 is an end view of a lower section of an array of hexagonally shaped tubes.

Referring now to the drawings and, in particular, to FIG. 1, a section of a straw tube array 20 is formed from a conductive material into a partial hexagonal shape. It is not necessary for the section to be exactly half of the tube; it may be more or less, as conditions require. This section can be extruded, cut, grooved or machined or be formed by known methods of molding, including, but not limited to, vaccuforming or casing. The section has both a concave inner side 21 and a convex outer side 23. Section 20 is made of aluminized mylar. It could be made of any conductive material, including, but not limited to, plastic or mylar, metalized with films of copper, silver, gold or other conductive material.

Figure 2:
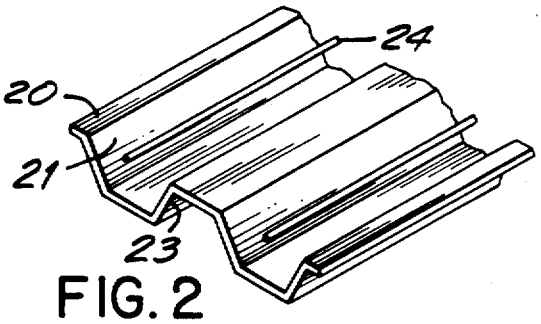
FIG. 2 is a perspective view of the lower section of the hexagonal tube array of FIG. 1 showing conductive wires in the center of the tube sections.

Once a section 20 is formed, a conductive wire 24 is positioned longitudinally along the length of the tube section 20 as presented in FIG. 2. Wire 24 is preferably made of gold-plated tungsten but any high strength, highly conductive material, such as copper or silver, can be used as desired. Wire 24 is laid through the open portion of tube section 20. Wire alignment in the completed tube is maintained by tensioning and affixing each end of the wire to bus bars 30 running across the width of the array at both ends (best seen in FIG. 4). Plating, welding, adhesive, compressive bondage, or the like, may also be used to affix wire 24. It is not necessary, but it is desirable, to tension wire 24 as it is positioned proximate the geometric center of the tube; it may be tensioned later.

Figure 3:
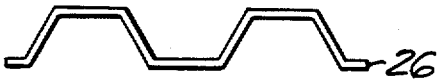
FIG. 3 is an end view of a mating section of the hexagonal structure of FIG. 1.

FIG. 3 is an illustration of the opposing section of a hexagonal tube array 26 which is formed to close lower section 20. The same method of forming section 20 may be used to form mating section 26.

Figure 4:
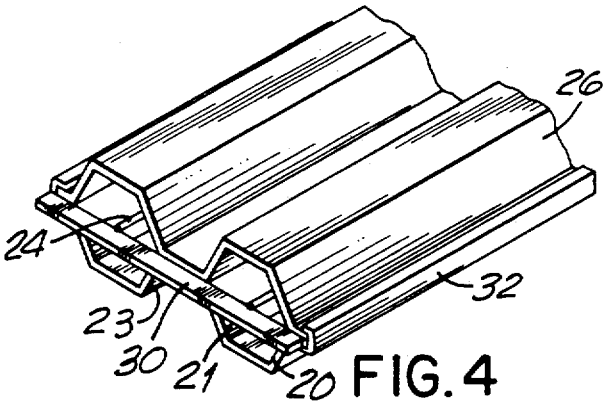
FIG. 4 is a perspective view o an assembled hexagonal tube array of two chambers.

An array of two completed hexagon straw tubes 28 is illustrated in FIG. 4. Conductive wires 24 are tensioned and held in place by bus bars 30. Clamps 32 are used to hold the two sections 20 and 26 of the tube in place. Alternatively, the two sections can be joined by heating, sealing, gluing, bonding, welding or the like. Tensioning of conductive wire 24 can be accomplished by a variety of methods including, but not limited to, the use of bus bars 30 to stretch attached wires 24 after wires 24 are encapsuled in tube array 28.

Figure 5:
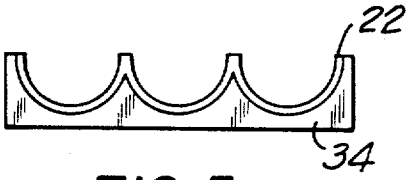
FIG. 5 is an end view of a lower section of a circular tube array fitted into a mold.

In another embodiment of the present invention, a circular section 22 is used as illustrated in FIG. 5. This structure is formed by a molding technique. First, a mold of the suitable size and shape must be constructed, in this case, a circular mold 34. The tube section may then be formed by using vaccuforming, or some other molding technique. The plastic or mylar material may be metalized before or after the molding process. Conductive layer 22 of the desired thickness is formed on the contoured mold. The molding is done using known techniques, such as, for example, plating or vapor deposition. FIG. 5 depicts a mold for three (3) sections of circular straw tubes, however, any number of tube sections may be formed with a single mold.

Figure 6:
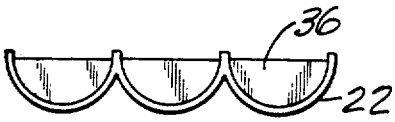
FIG. 6 is an end view of a circular tube array section containing removable supporting material.
Figure 7:
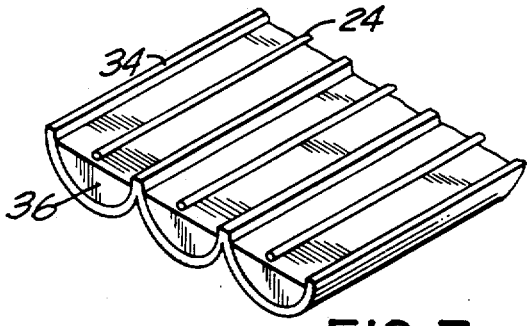
FIG. 7 is a perspective view of a section of a circular tube array showing conductive wires in the center of the tube sections supported by the removable supporting material.

In the next step of the process, removable supporting material 36 is placed in section 22 as seen in FIG. 6. In this case, the supporting material is leachable plastic, such as polyethylene-glycol (marketed by Dow Chemical Co. as "POLY OX 5000"). Supporting material 36 is used to support wire 24 as it is laid, and to hold wire 24 in tension.

Conductive wire 24 is placed in a location in or on the supporting material such that it rests proximate the geometric center of the completed tube. The positioning can be accomplished by a number of means. For example, a grove could be made in the plastic and the wire placed in it; a wire machine could heat the wire and plastic, for instance with an ultrasonic stylus or laser, sufficiently to embed the wire in the plastic in the desired location; the plastic form could be made slightly undersized so that a wire laid on top of the form would be in the finished tube's center.

One method of positioning and securing wire 24 inside of tube array section 20 as presented above is through the use of wire scribing technology. U.S. Pat. No. 3,674,602 (Keogh, et al.) teaches the use of an apparatus capable of scribing thin wire in a predetermined location and tacking the wire in position. Such an apparatus, or a modified version of it, could be successfully utilized to lay wire 24 in position and secure it in place (under tension, if desired).

Wire 24 may be laid under tension by differing the speed at which wire 24 is fed out as compared to the speed at which a wire scribing transport mechanism moves tube array 20 in a wire scribing process. In such a process, wire 24 is typically fed at a speed equivalent to the workpiece's movement on the scribe machine plate; the plate movement controls the position and direction of wire 24 and the rate of installation of wire 24. When the workpiece is moving at a faster rate relative to the rate wire 24 is being fed, a tension is created in wire 24.

The wire could, but not necessarily, be bonded to a removable, thermoplastic supporting material by ultrasonic means, thus keeping the wire in tension until both ends of wire 24 are bonded to bus bars 30. If bus bars 30 were coated with a thermoset material which is in an uncured or semi-cured state, a high energy pulse may be used at the bonding locations to affix wire 24 in place so as to maintain wire 24 in tension. Once cured, the thermoset material would hold wire 24 in place, and in tension, permanently.

Once wire 24 is secured, the supporting material 36 is removed. One skilled in the art will realize that the nature of removable supporting material used will dictate the appropriate removal method. For example, if thermoplastic is used as the supporting material, it can be removed by melting. Removal of the material may also be accomplished by techniques which include, but are not limited to, leaching, depolymerizing, dissolving and etching. If not removed at this point in the manufacturing process, the supporting material can be removed later.

Figure 8:
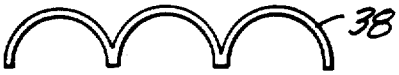
FIG. 8 is an end view of a mating section of the circular array structure of FIG. 5

FIG. 8 shows the metalized section of the circular tube 38 that is used as the mating section. This section can also be formed using a mold.

Figure 9:
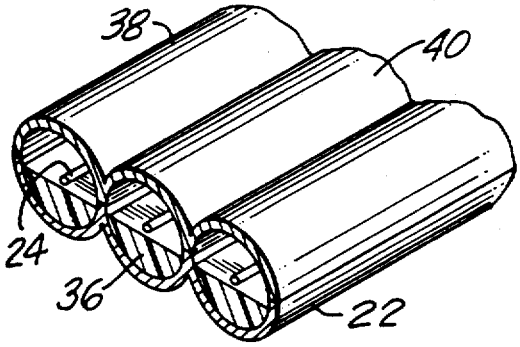
FIG. 9 is a perspective view of the assembled circular tube array prior to removal of the supporting material.

The two sections are affixed together and connected in an array 40, as depicted in FIG. 9. Many such structures may be assembled in an array to form a straw tube drift chamber detecting system. For example, in the Superconductor Super Collider (SSC) project, it is projected that up to 800 thousand tubes of 100 cm length, 4 mm diameter, with 2 mil. wire will be needed. Given these parameters, the strength of the tube array and the ease of manufacturing the arrays are key.

Figure 10:
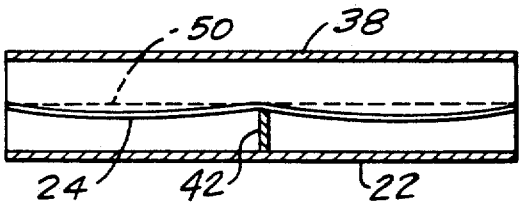
FIG. 10 is a side view in cross-section of an elongated horizontally positioned circular straw tube with conductive wire supported by a spacer along the length of the tube.

Because the tube diameter is small and the wires are thin, problems that normally arise when affixing the ends of a hanging wire are even more pronounced. For instance, when a wire is stretched horizontally, it tends to sag in the middle, between points of contact. In the case of thin wire, this sag (the cantilever effect) places weight on the wire that could lead to inaccurate measurements or to wire breakage. FIG. 10 shows a completed elongated circular tube in a horizontal position. The phantom line 50 depicts the geometric center of the tube. Conductive wire 24 is supported, however, in increments along the tubes length by a spacer 42 to decrease the overall sag in wire 24. Spacer 42 is made of non-leachable plastic and can be made of any material that supports the wire under the use conditions without greatly interfering with the tube measurements. The increment was determined by establishing the amount of sag in the wire from gravity per unit measure and determining at what point among the tube, spacer 42 could be placed minimizing the sag while optimizing the tube's sensitivity. By tacking (bonding) wire 24 to each support, a more even tension can be maintained on the wire. This embodiment therefore reduces the cantilever problem.

Figure 11:
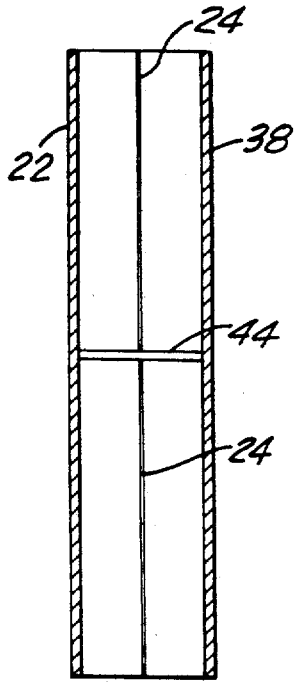
FIG. 11 is a side view in cross-section of an elongated circular straw tube in a vertical position having a spacer supporting the conductive tube.

Another problem that becomes more pronounced with the use of thinner wire is breakage due to the weight of the wire in a vertical position. In FIG. 11, the circular tube is in a vertical position. The weight of wire 24 places the top portion of the wire under more tension while the lower portion tends to bulk somewhat due to a lack of tension. Therefore, the top portion is more inclined to break due to the weight. In addition, while the top portion is centered, the lower portion tends to drift off-center to a position that could effect the accuracy of the measurements. The use of spacers 44 to support wire 24 by tacking wire 24 to spacers 44 in predetermined increments decreases the overall amount of tension, reduces bulking, and negates the breaks caused by high tension in longer wires.

Figure 12:
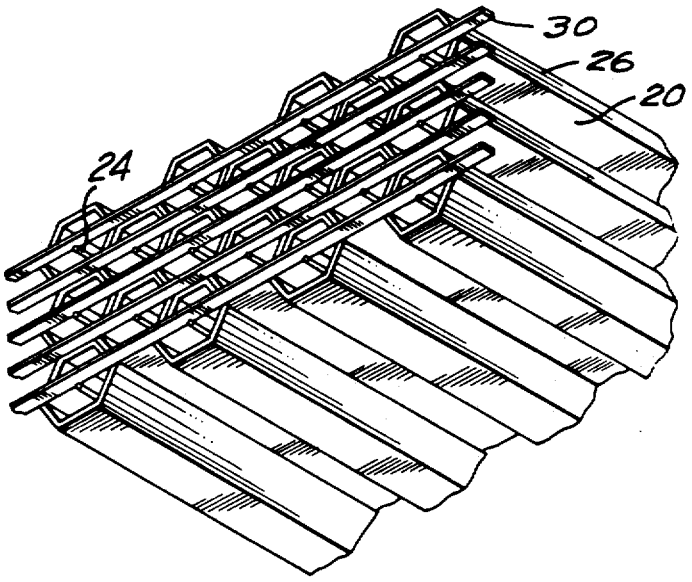
FIG. 12 is a perspective view indepth of an array of hexagonal straw tubes.

FIG. 12 is a perspective view indepth of a completed array of hexagonal straw tube drift chambers. As can be seen from the drawings, the hexagonal shape allows for packing with an absence of gaps between the tubes. For times when larger numbers of tubes are needed, such as with the SSC project, this packing ability allows for a greater number of tubes in a smaller space. The increased packing density also assists in improving the resolution.

Figure 13:
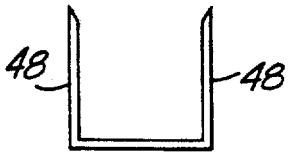
FIG. 13 is an end view of the triangular tube in the open position.
Figure 14:
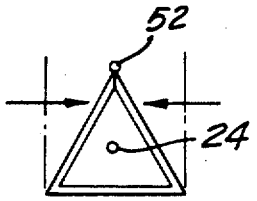
FIG. 14 is an end view of the triangular tube containing a conductive wire after the tube is closed.

In an alternate embodiment shown in FIG. 13 and 14 a triangular tube configuration is shown before and after the conductive wire was placed in position. All of the material necessary to encapsulate the wire is formed as a unit by using one of the methods described above for making tube sections. After wire 24 is in position (supporting material may be used if desired), the tube is closed by applying a force to sides 48 adjacent to the opening and forcing the sides together. Any type of closure force may be used that completes the action without damaging the tube.

After the tube is closed and the sides are bonded together, the process is continued as described with the embodiments shown above. Any appropriate bonding technique may be used to create bond 52, including adhesive or heat sealing. A triangular shape has been shown, however, one skilled in the art would realize that other shapes also could be used.

Although only a few embodiments have been described in detail, it should be noted that numerous variations may be made within the scope of this invention. The terms and expressions have been used as terms of description and not terms of limitation. There is no intention to use the terms or expressions to exclude any equivalents of features shown and described or portions thereof.

I claim:

1. A process for manufacturing a straw tube drift chamber, comprising the steps of:

(a) forming at least one longitudinal section of said straw tube in a predetermined shape and length from a conductive material, said section being open along its longitudinal length;

(b) positioning a conductive wire longitudinally in said section of said straw tube proximate the geometric center;

(c) closing said section of said straw tube such that said conductive wire is enclosed in said straw tube;

(d) isolating said straw tube from said conductive wire such that a potential difference may be created between said tube and said wire; and (e) filling the area between said straw tube and said conductive wire with ionizable gas.

2. The process, as recited in claim 1, where the conductive material is metalized plastic.

3. The process, as recited in claim 1, where the conductive material is made of gold-plated tungsten.

4. The process, as recited in claim 1, where said ionizable gas is a gas selected from the group consisting of carbon tetrafluoride, argon-ethane, and freon.

5. The process, as recited in claim 1, where said wire is under tension before said wire is electrically isolated from said tube.

6. The process, as recited in claim 1, where said section is one-half of said straw tube.

7. A process, as recited in claim 1, where said straw tube is closed by applying a force to said section of straw tube to enclose said wire bonding said sections in place.

8. A process, as recited in claim 1, wherein an array of said straw tube drift chambers is formed, said step of forming at least one longitudinal section of said straw tube includes forming an open longitudinal straw tube array section, said step of positioning a conductive wire includes the positioning of two or more wires so that a conductive wire extends longitudinally in each straw tube section of said straw tube array section, and said step of closing comprises covering the openings with further tube sections to complete said array of straw tubes.

9. A process, as recited in claim 1, where said straw tube section is closed by bonding a second section of the tubes to the first section to form a complete straw tube of a desired shape.

10. A process for manufacturing straw tube drift chambers, comprising the steps of:

(a) molding a plurality of longitudinal straw tube sections;

(b) forming a conductive film onto said sections;

(c) adding a removable supporting material in said sections;

(d) affixing a conductive wire in said supporting material proximate the geometric center of said section;

(e) forming a plurality of mating straw tube sections;

(f) bonding said mating sections to said first sections;

(g) removing said supporting material;

(h) electrically isolating said conductive wire and said tube sections; and (i) adding ionizable gas to said tube sections.

11. The process, as recited in claim 10, where said first and mating straw tube sections are made by vacuforming.

12. The process, as recited in claim 10, where said first and mating straw tube sections are made by extrusion.

13. The process, as recited in claim 10, where said first and mating straw tube sections are made by milling.

14. The process, as recited in claim 10, where said supporting material is removed by leaching.

15. The process, as recited in claim 10, where said supporting material is removed by melting.

16. The process, as recited in claim 10, where said supporting material is removed by etching.

17. The process, as recited in claim 10, where said supporting material is removed by dissolving.

18. The process, as recited in claim 10, where said supporting material is removed by depolymerizing.

19. The process, as recited in claim 10, where said supporting material is a composition selected from the group consisting of thermoplastics.

20. The process, as recited in claim 10, where said first and mating sections are made of aluminized polycarbonate and mylar.

* * * * *